US010806264B1

(12) United States Patent
Chen

(10) Patent No.: US 10,806,264 B1
(45) Date of Patent: Oct. 20, 2020

(54) CHAIR HAVING ADJUSTABLE BACKREST

(71) Applicant: Inno-Sports Co., Ltd., Xiamen (CN)

(72) Inventor: Renhua Chen, Xiamen (CN)

(73) Assignee: Inno-Sports Co., LTD., Xiamen (CN)

( * ) Notice: Subject to any disclaimer, the term of this patent is extended or adjusted under 35 U.S.C. 154(b) by 0 days.

(21) Appl. No.: 16/881,234

(22) Filed: May 22, 2020

(30) Foreign Application Priority Data

Oct. 9, 2019 (CN) ..... 2019 2 1681051 U

(51) Int. Cl.
*A47C 7/48* (2006.01)
*A47C 7/02* (2006.01)
*A47C 4/20* (2006.01)

(52) U.S. Cl.
CPC ..... *A47C 7/48* (2013.01); *A47C 4/20* (2013.01); *A47C 7/029* (2018.08)

(58) Field of Classification Search
None
See application file for complete search history.

(56) References Cited

U.S. PATENT DOCUMENTS 349,907 A * 9/1886 Shults ..... A47C 3/025 297/292
704,109 A * 7/1902 Richards ..... A47C 7/44 297/291
1,910,760 A * 5/1933 Garrow ..... A47C 7/402 297/374
3,982,785 A * 9/1976 Ambasz ..... A47C 1/023 297/160
4,084,850 A * 4/1978 Ambasz ..... A47C 3/025 297/317
6,095,611 A * 8/2000 Bar ..... A61G 5/1067 297/440.21
D443,429 S 6/2001 Mower et al.
6,257,668 B1 * 7/2001 Chou ..... A47C 1/03 297/411.32
6,543,842 B2 4/2003 Haney
D477,470 S 7/2003 Haney et al.
D477,939 S 8/2003 Haney et al.
6,612,653 B2 * 9/2003 Takata ..... B60N 2/856 297/408

(Continued)

FOREIGN PATENT DOCUMENTS

WO WO-9103192 A1 * 3/1991 ..... A47C 7/445
WO WO-2019078397 A1 * 4/2019 ..... A47C 7/46

*Primary Examiner* — David E Allred
(74) *Attorney, Agent, or Firm* — Morgan, Lewis & Bockius LLP

(57) ABSTRACT

A chair includes a seat, a backrest and a frame to support the seat and backrest. The frame includes first and second supports disposed at first and second sides of the chair, respectively. The chair also includes a first engaging mechanism pivotally coupling the backrest with the first support, and a second engaging mechanism pivotally coupling the backrest with the second support. The first or second engaging mechanism includes first, second and third members. The first member fixedly is coupled with the backrest. The second member pivotally connects the first member of the respective engaging mechanism with the first or second support, thereby allowing the backrest to rotate along a first axis in the width direction of the chair. The third member is fixedly coupled with the first or second support and configured to limit the rotation of the backrest.

15 Claims, 10 Drawing Sheets

(56) References Cited

U.S. PATENT DOCUMENTS

| | | | | |
|---|---|---|---|---|
| 6,871,906 | B2 | 3/2005 | Haney | |
| D507,425 | S | 7/2005 | Ashby et al. | |
| 6,974,188 | B2 * | 12/2005 | Turner | A47C 4/04 297/270.2 |
| 7,014,261 | B2 | 3/2006 | Haney | |
| 7,017,986 | B2 | 3/2006 | Degen et al. | |
| D519,292 | S | 4/2006 | Ashby | |
| D523,254 | S | 6/2006 | Nye et al. | |
| 8,029,059 | B2 * | 10/2011 | Smith | A47C 3/04 297/239 |
| D655,932 | S | 3/2012 | Ashby et al. | |
| D667,649 | S | 9/2012 | Waite et al. | |
| D686,007 | S | 7/2013 | Johnson et al. | |
| 8,721,003 | B2 | 5/2014 | Waite et al. | |
| D710,623 | S | 8/2014 | Peery et al. | |
| D721,528 | S | 1/2015 | Peery et al. | |
| 10,182,953 | B2 * | 1/2019 | Tsuber | A61G 5/122 |
| D839,650 | S | 2/2019 | Winter et al. | |
| 10,448,744 | B2 | 10/2019 | Phillips | |
| 2004/0104608 | A1 * | 6/2004 | Ambasz | A47C 1/03 297/239 |
| 2011/0181085 | A1 * | 7/2011 | Pfeifer | A47C 7/441 297/285 |
| 2012/0091300 | A1 * | 4/2012 | Bee | A61G 5/1067 248/219.4 |

* cited by examiner

CHAIR HAVING ADJUSTABLE BACKREST

CROSS-REFERENCE TO RELATED APPLICATIONS

The present application claims priority to Chinese Utility Model Application CN 201921681051.X filed Oct. 9, 2019. The disclosure of the application is incorporated herein for all purposes by reference in its entirety.

FIELD OF THE INVENTION

The present invention generally relates to chairs, and in particular, relates to chairs having adjustable backrests.

BACKGROUND

Some existing chairs include backrests. The backrests, however, are generally fixed in a vertical position or tilted at a fixed angle with respect to the ground. Such chairs are uncomfortable to sit in, particularly, for long duration. For instance, chairs with backrests fixed in a vertical position are not comfortable for users to lean back, and chairs with backrests tilted at a fixed angle do not provide support when users sit upright.

Given the current state of the art, there remains a need for chairs that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present disclosure provides chairs having adjustable backrests that enhance the flexibility and comfort of the chairs. A chair in general includes a seat, a backrest and a frame to support the seat and backrest. The backrest is pivotally coupled with the frame. The backrest is rotatable within a certain range (e.g., between first and second positions) to better fit the profiles or postures of end users.

In various exemplary embodiments, the present disclosure provides a chair including a seat, a backrest and a frame to support the seat and backrest. The frame includes a first support disposed at a first side of the chair, and a second support disposed at a second side of the chair and spaced apart from the first support in a width direction of the chair. The chair also includes a first engaging mechanism disposed at the first side of the chair and pivotally coupling the backrest with the first support, and a second engaging mechanism disposed at the second side of the chair and pivotally coupling the backrest with the second support. A respective engaging mechanism in the first and second engaging mechanisms includes first, second and second members. The first member is fixedly coupled with the backrest. The second member pivotally connects the first member of the respective engaging mechanism with a corresponding support in the first and second supports, thereby allowing the backrest to rotate along a first axis in the width direction of the chair. The third member is fixedly coupled with the corresponding support, and configured to limit the rotation of the backrest.

In an exemplary embodiment, the corresponding support serves as a leg of the frame, and the respective engaging mechanism is connected with an upper end portion of the corresponding support.

In an exemplary embodiment, the backrest is formed with one or more indentations to accommodate at least a portion of the first member of the respective engaging mechanism, at least a portion of the second member of the respective engaging mechanism, or both.

In some exemplary embodiments, the corresponding support includes a first hole and a first slot, wherein the first slot is formed at a side of the corresponding support facing the backrest. The first member of the respective engaging mechanism includes a second hole and a second slot. The third member of the respective engaging mechanism is disposed between the corresponding support and the first member of the respective engaging mechanism. The third member includes a third hole, a first lug disposed in the first slot of the corresponding support, and a second lug disposed in the second slot of the first member of the respective engaging mechanism. The second member of the respective engaging mechanism includes a fastener passing through the first hole of the corresponding support, the second hole of the first member of the respective engaging mechanism, and the third hole of the third member of the respective engaging mechanism. The second slot of the first member and the second lug of the third member are configured such that a distance between a first edge and a second edge of the second slot of the first member of the respective engaging mechanism is greater than a distance between a first edge and a second edge of the second lug of the third member of the respective engaging mechanism. As such, the backrest is allowed to rotate between a first position, at which the first edge of the second slot of the first member of the respective engaging mechanism abuts the first edge of the second lug of the third member of the respective engaging mechanism, and a second position, at which the second edge of the second slot of the first member of the respective engaging mechanism abuts the second edge of the second lug of the third member of the respective engaging mechanism.

In an exemplary embodiment, the second slot of the first member of the respective engaging mechanism includes a convex third edge to aid rotation of the backrest along the first axis in the width direction of the chair between the first and second positions.

In some exemplary embodiments, the first member of the respective engaging mechanism includes a first portion, a second portion bent with respect to the first portion, a third portion between the first and second portions, wherein the first portion is fixedly connected with the backrest, the second hole is formed at the second portion, and the second slot is formed at the third portion.

In an exemplary embodiment, the backrest includes first, second and third indentations. The first indentation is recessed from a back surface of the backrest toward a front surface of the backrest to accommodate the first portion of the first member of the respective engaging mechanism. The second indentation is recessed inwardly from a side surface of the backrest to accommodate the second portion of the first member of the respective engaging mechanism. The third indentation is recessed inwardly from a bottom surface of the second indentation to accommodate an end portion of the fastener of the second member of the respective engaging mechanism.

In an exemplary embodiment, the third hole is formed at a body portion of the third member of the respective engaging mechanism, the first lug is bent with respect to the body portion in a first direction, and the second lug is bent with respect to the body portion in a second direction that is different than the first direction.

In some exemplary embodiments, the respective engaging mechanism further includes a fourth member fixedly coupled with the backrest and configured to cover at least a portion of the first member of the respective engaging mechanism.

In some exemplary embodiments, the respective engaging mechanism further includes a spacer disposed between the first and third members of the respective engaging mechanism. The spacer includes a corrugated surface having a plurality of radial ridges, a plurality of radial grooves, or a plurality of alternate radial ridges and grooves.

In various exemplary embodiments, the present disclosure provides a chair including first and second front supports, first and second rear supports, first and second links, a seat and a backrest. The first and second front supports are spaced apart in a width direction of the chair. The first and second rear supports are spaced apart in the width direction of the chair. The first link has a first end pivotally connected with the first front support and a second end pivotally connected with the first rear support. The second link has a first end pivotally connected with the second front support and a second end pivotally connected with the second rear support. The seat has a first side portion pivotally connected with the first front support and the first rear support below the first link and a second side portion pivotally connected with the second front support and the second rear support below the second link. The backrest has a first side portion pivotally connected with the first front support above the first link and a second side portion pivotally connected with the second front support above the second link such that the backrest is rotatable along a first axis in the width direction of the chair.

In some exemplary embodiments, a respective side portion in the first and second side portions of the backrest is pivotally connected with a corresponding front support in the first and second front supports by an engaging mechanism. The engaging mechanism includes first, second and second members. The first member of the engaging mechanism is fixedly coupled with the backrest. The second member of the engaging mechanism pivotally connects the first member of the engaging mechanism with the corresponding front support, thereby allowing the backrest to rotate along the first axis in the width direction of the chair. The third member is fixedly coupled with the corresponding support and configured to limit the rotation of the backrest.

In an exemplary embodiment, the backrest is formed with one or more indentations to accommodate at least a portion of the first member of the engaging mechanism, at least a portion of the second member of the engaging mechanism, or both.

In some exemplary embodiments, the corresponding front support includes a first hole and a first slot, wherein the first slot is formed at a side of the corresponding front support facing the backrest. The first member of the engaging mechanism includes a second hole and a second slot. The third member of the engaging mechanism is disposed between the corresponding front support and the first member of the engaging mechanism. The third member includes a third hole, a first lug disposed in the first slot of the corresponding front support, and a second lug disposed in the second slot of the first member of the engaging mechanism. The second member of the engaging mechanism includes a fastener passing through the first hole of the corresponding front support, the second hole of the first member of the engaging mechanism, and the third hole of the third member of the engaging mechanism. The second slot of the first member and the second lug of the third member are configured such that a distance between a first edge and a second edge of the second slot of the first member of the engaging mechanism is greater than a distance between a first edge and a second edge of the second lug of the third member of the engaging mechanism. As such the backrest is allowed to rotate between a first position, at which the first edge of the second slot of the first member of the engaging mechanism abuts the first edge of the second lug of the third member of the engaging mechanism, and a second position, at which the second edge of the second slot of the first member of the engaging mechanism abuts the second edge of the second lug of the third member of the engaging mechanism.

In an exemplary embodiment, the second slot of the first member of the engaging mechanism includes a convex third edge to aid rotation of the backrest along the first axis in the width direction of the chair between the first and second positions.

In some exemplary embodiments, the first member of the engaging mechanism includes a first portion, a second portion bent with respect to the first portion, a third portion between the first and second portions, wherein the first portion is fixedly connected with the backrest, the second hole is formed at the second portion, and the second slot is formed at the third portion.

In an exemplary embodiment, the backrest includes first, second and third indentations. The first indentation is recessed from a back surface of the respective side portion of the backrest toward a front surface of the respective side portion of the backrest to accommodate the first portion of the first member of the engaging mechanism. The second indentation is recessed inwardly from a side surface of the respective side portion of the backrest to accommodate the second portion of the first member of the engaging mechanism. The third indentation is recessed inwardly from a bottom surface of the second indentation to accommodate an end portion of the fastener of the second member of the engaging mechanism.

In an exemplary embodiment, the third hole is formed at a body portion of the third member of the engaging mechanism, the first lug is bent with respect to the body portion in a first direction, and the second lug is bent with respect to the body portion in a second direction that is different than the first direction.

In some exemplary embodiments, the engaging mechanism further includes a fourth member fixedly coupled with the backrest and configured to cover at least a portion of the first member of the engaging mechanism.

In some exemplary embodiments, the engaging mechanism further includes a spacer disposed between the first and third members of the engaging mechanism, wherein the spacer includes a corrugated surface having a plurality of radial ridges, a plurality of radial grooves, or a plurality of alternate radial ridges and grooves.

The chairs of the present disclosure have other features and advantages that will be apparent from, or are set forth in more detail in, the accompanying drawings, which are incorporated herein, and the following Detailed Description, which together serve to explain certain principles of exemplary embodiments of the present disclosure.

BRIEF DESCRIPTION OF THE DRAWINGS

The accompanying drawings, which are incorporated into and constitute a part of this specification, illustrate one or more exemplary embodiments of the present disclosure and, together with the Detailed Description, serve to explain the principles and implementations of exemplary embodiments of the invention.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementation of exemplary embodiments of the present disclosure as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present disclosure will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present disclosure are described in the context of chairs having adjustable backrests. A chair in general includes a seat, a backrest and a frame to support the seat and backrest. The seat, backrest and frame each can be made of various materials including but not limited to plastics, metal (e.g., steel, aluminum, iron) and wood. For instance, in some exemplary embodiments, the seat or backrest is made of a plastic material by injection molding, blow molding or the like, and the frame is composed of metallic bars, tubes or the like.

Figure 1:
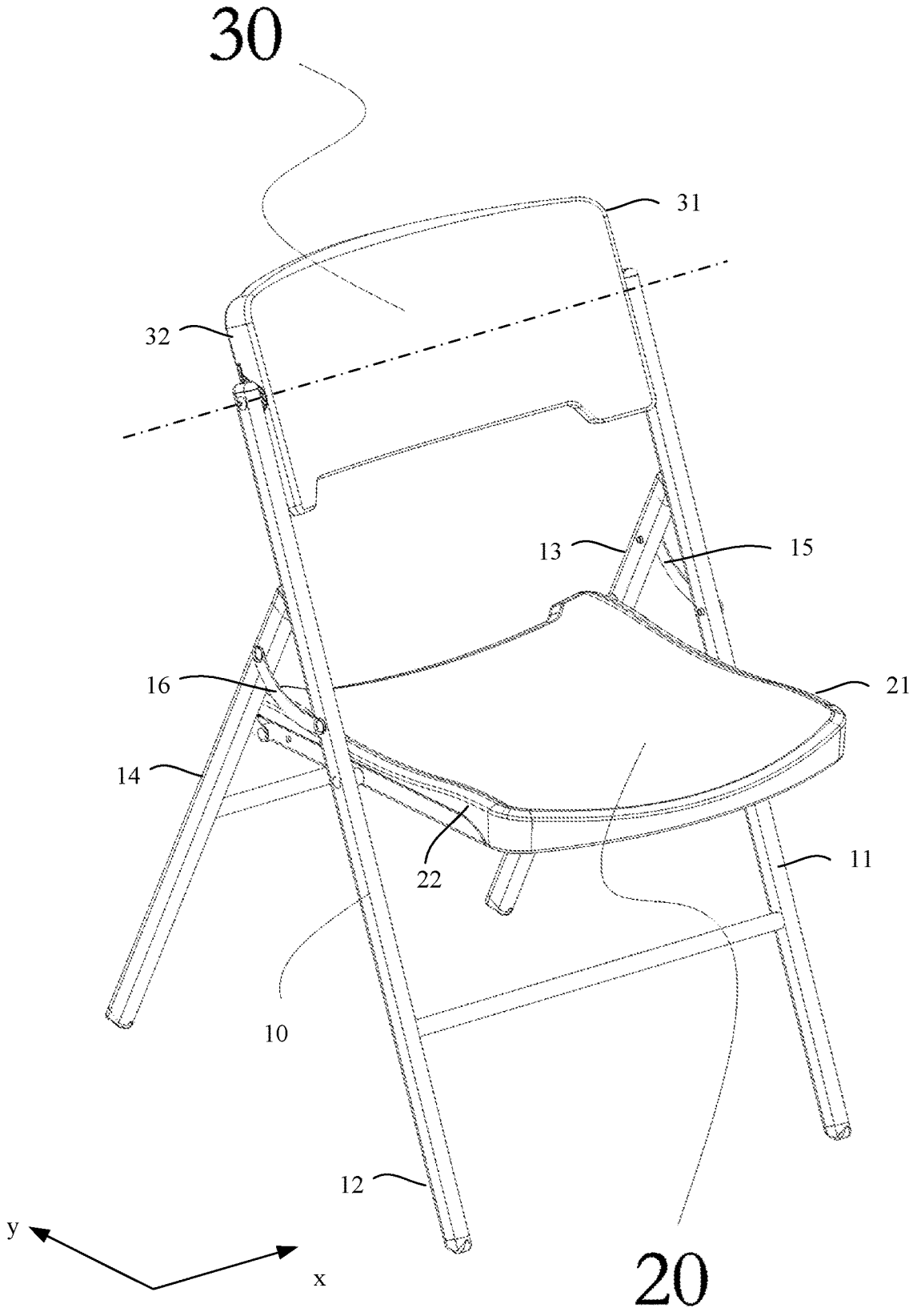
FIG. 1 is a front perspective view illustrating an exemplary chair in accordance with exemplary embodiments of the present disclosure.

For instance, referring to FIG. 1, there is depicted an exemplary chair including a frame such as frame 10, a seat such as seat 20 and a backrest such as backrest 30. In some exemplary embodiments, the frame includes a first front support such as front support 11 and a second front support such as front support 12. The first and second front supports are spaced apart in a width direction of the chair (e.g., the x-direction in FIG. 1). The frame also includes a first rear support such as rear support 13 and a second rear support such as rear support 14. The first and second rear supports are also spaced apart in the width direction of the chair. The frame further includes a first link such as link 15 and a second link such as link 16. The first link has a first end pivotally connected with the first front support and a second end pivotally connected with the first rear support. The second link has a first end pivotally connected with the second front support and a second end pivotally connected with the second rear support.

The seat has a first side portion such as side portion 21 and a second side portion such as side portion 22. In some exemplary embodiments, the first side portion of the seat is pivotally connected with the first front support and the first rear support below the first link. The second side portion of the seat is pivotally connected with the second front support and the second rear support below the second link.

Figure 2A:
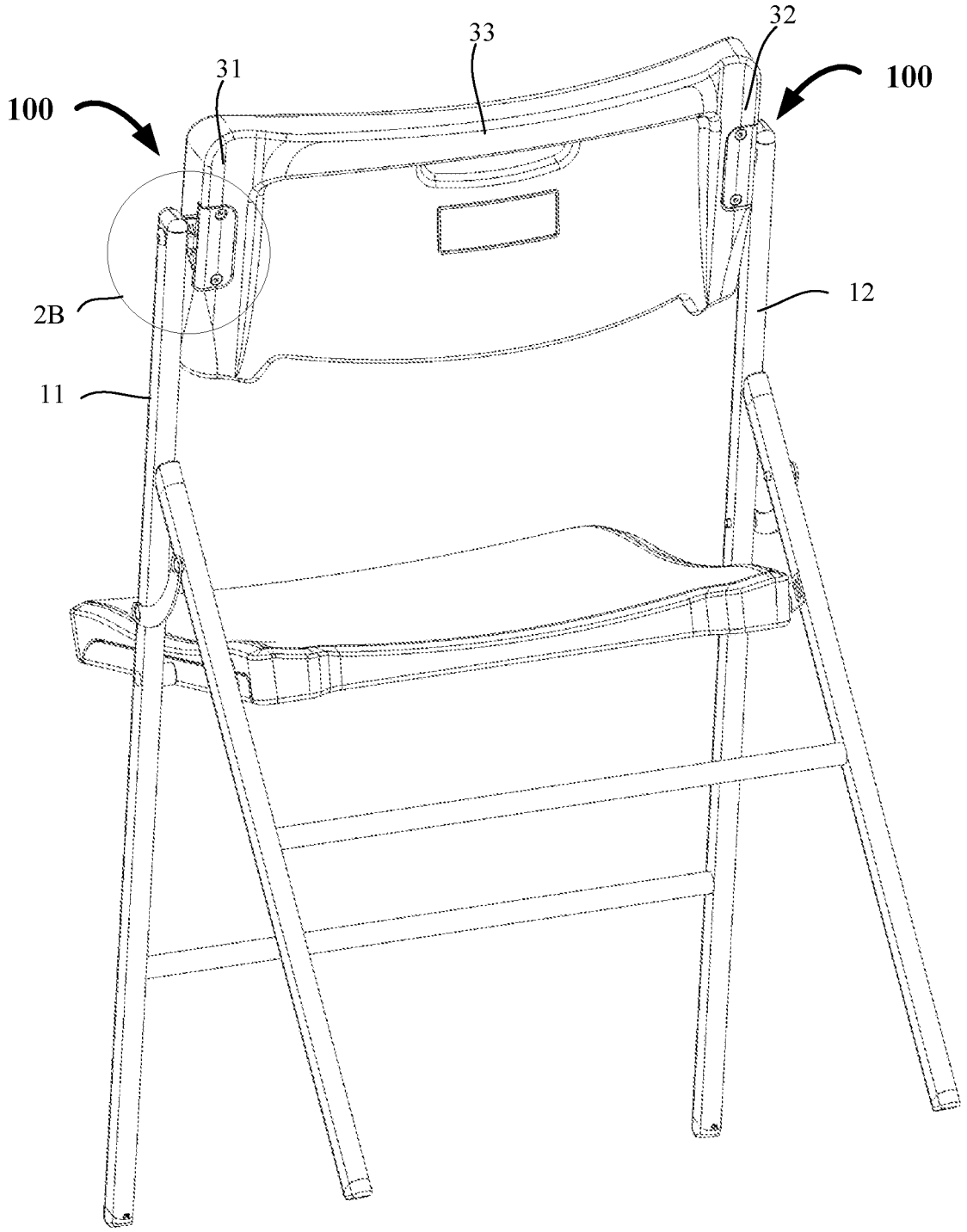
FIG. 2A is a first back perspective view illustrating an exemplary chair in accordance with exemplary embodiments of the present disclosure.
Figure 2B:
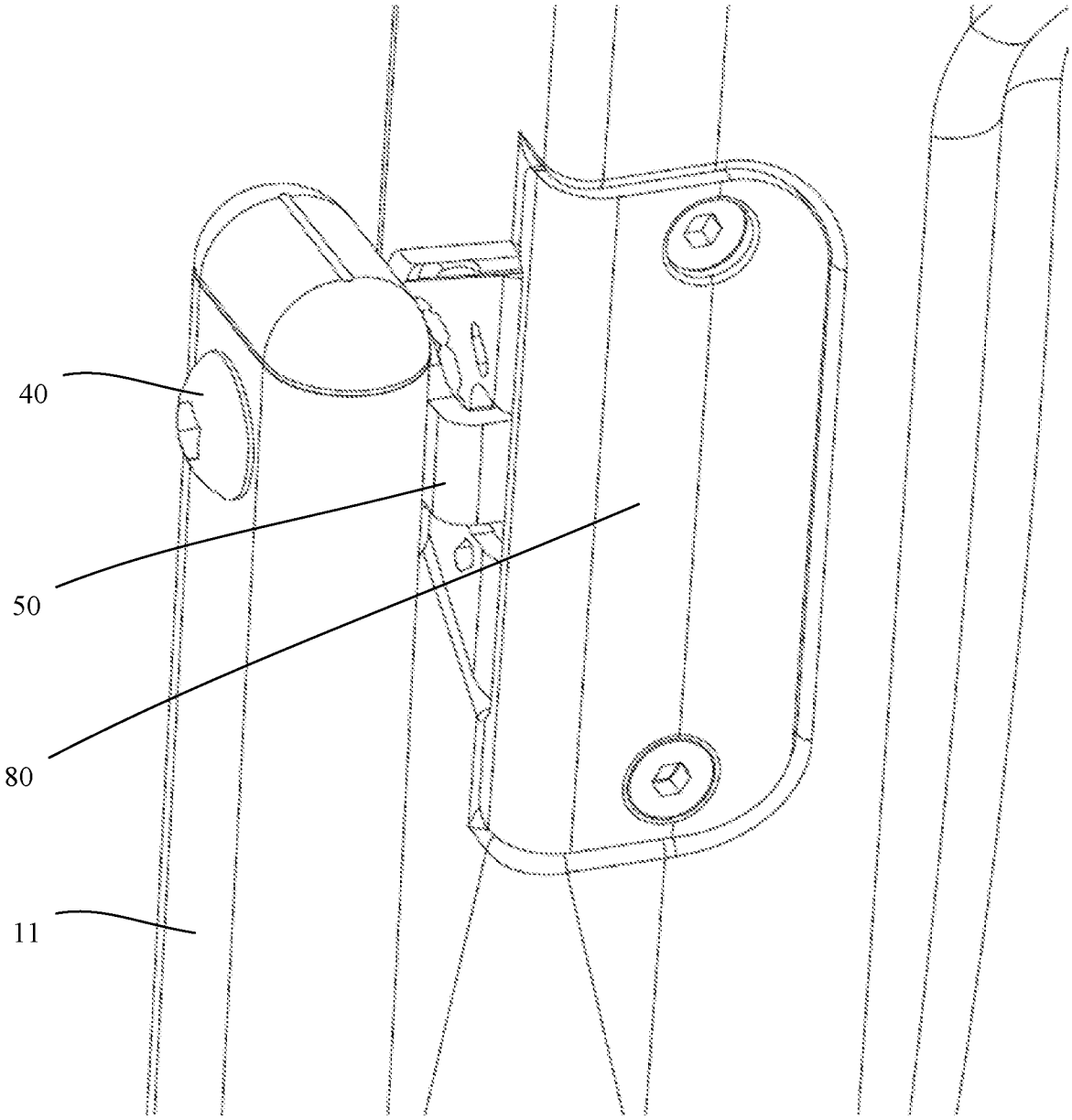
FIG. 2B is an enlarged view taken along circle 2B of FIG. 2A.
Figure 3A:
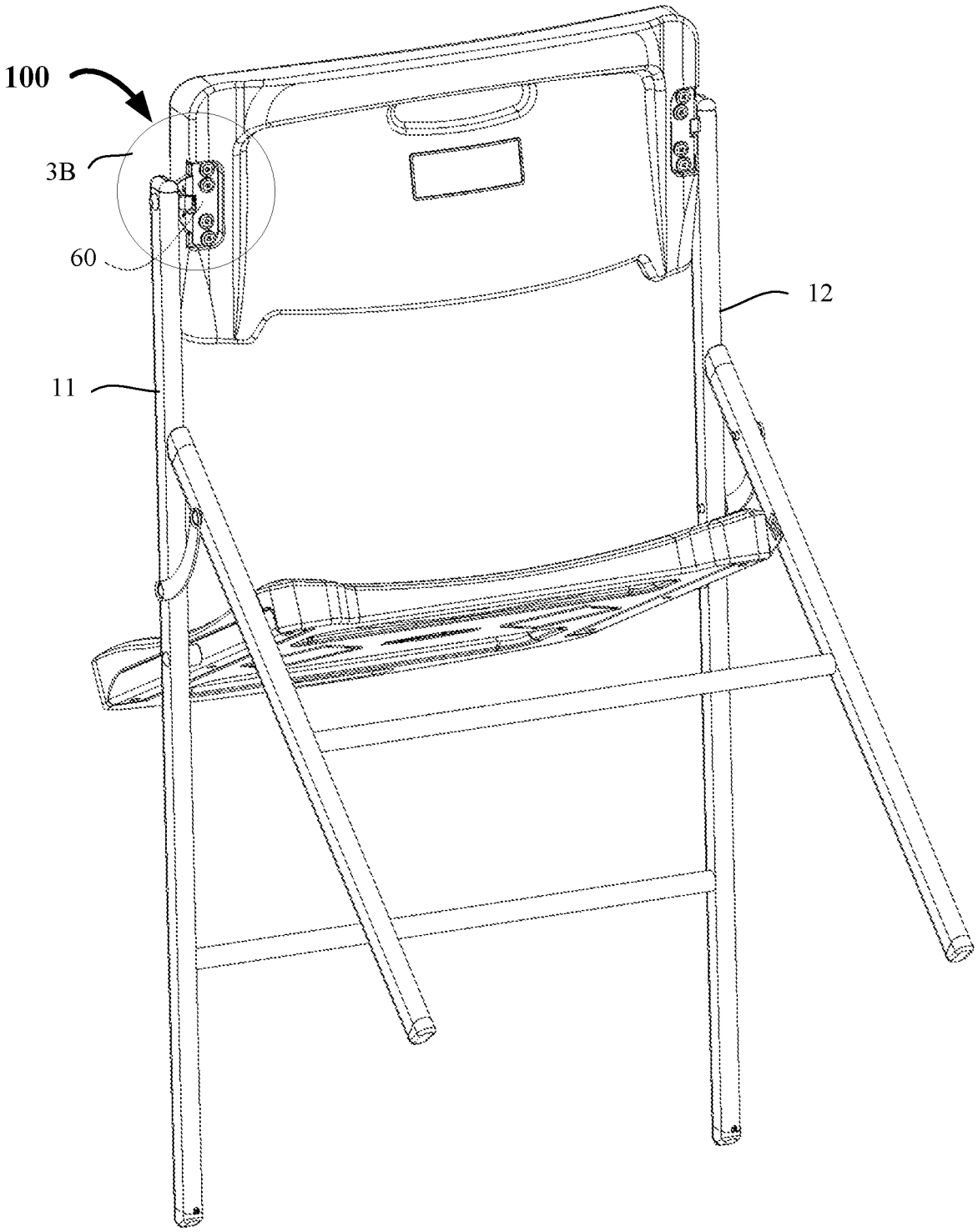
FIG. 3A is a second back perspective view illustrating an exemplary chair in accordance with exemplary embodiments of the present disclosure, in which member 80 of FIG. 2A is not shown.
Figure 3B:
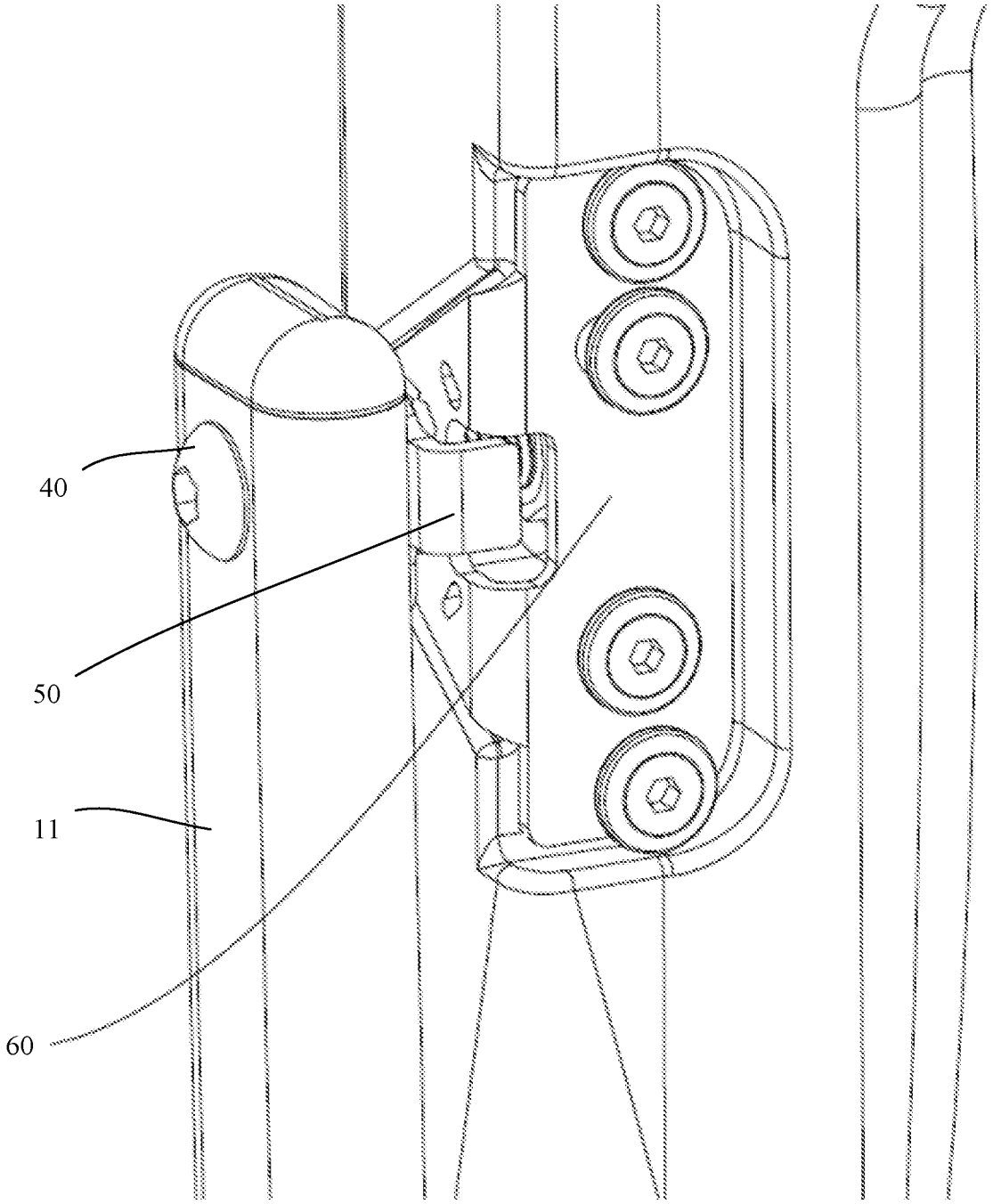
FIG. 3B is an enlarged view taken along circle 3B of FIG. 3A.
Figure 4A:
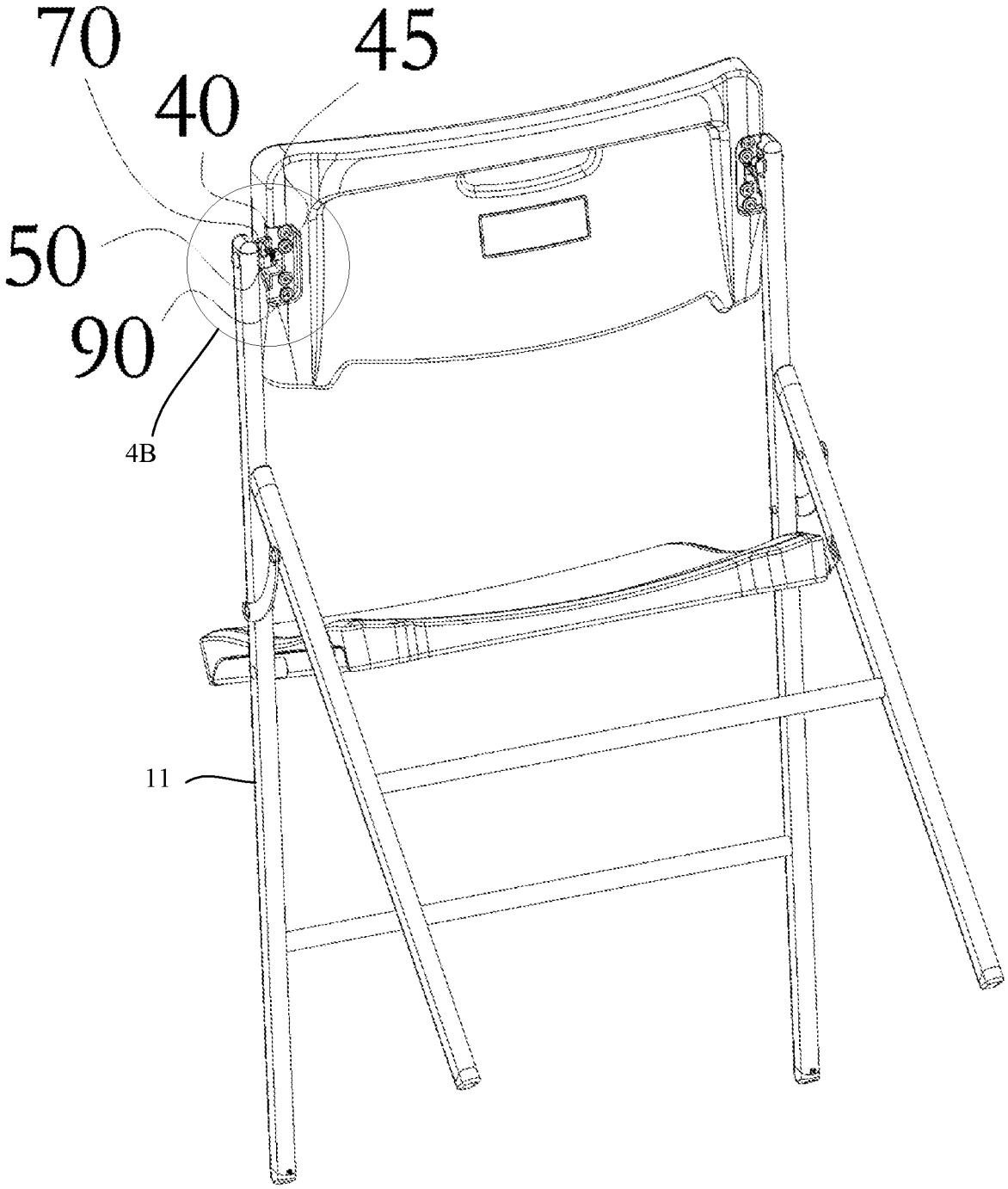
FIG. 4A is a third back perspective view illustrating an exemplary chair in accordance with exemplary embodiments of the present disclosure, in which member 60 of FIG. 3A is not shown.
Figure 4B:
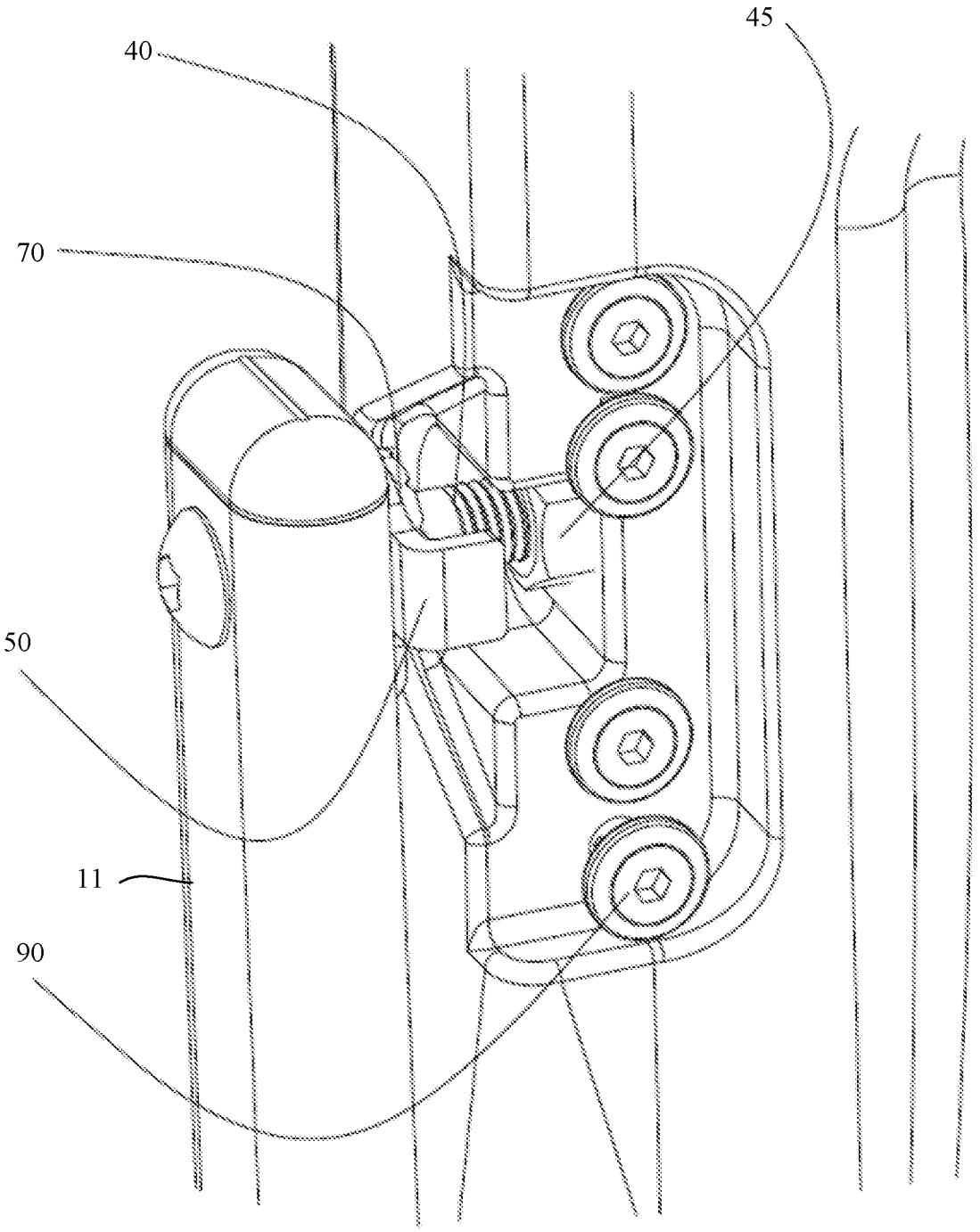
FIG. 4B is an enlarged view taken along circle 4B of FIG. 4A.

The backrest has a first side portion such as side portion 31 and a second side portion such as side portion 32. In some exemplary embodiments, the backrest includes a ridge, such as ridge 33 illustrated in FIG. 2A, that extends backward along at least a portion of an outer edge of the backrest. In an exemplary embodiment, side portion 31 and side portion 32 are segments of ridge 33.

In various exemplary embodiments, the first side portion of the backrest is pivotally connected with the first front support above the first link, and the second side portion of the backrest is pivotally connected with the second front support above the second link. As such, the backrest is rotatable along a first axis in the width direction of the chair (e.g., the dash line in FIG. 1), and thus can adjust its positions in accordance with the profiles or postures of end users. For instance, when a user leans back from an upright posture, the backrest rotates or can be rotated manually so that the backrest tilts backward to better fit the profile of the end user. When the user changes back to the upright position, the backrest rotates or can be rotated manually back to the vertical state. This enhances significantly the usability and comfort of the chair.

In some exemplary embodiments, the backrest is rotatably coupled with the frame by one or more engaging mechanisms that allow the backrest to rotate within a certain range (e.g., between a first position and a second position). For instance, referring to FIGS. 2A-4B, in some exemplary embodiments, the first side portion of the backrest is pivotally connected with the first front support by a first engaging mechanism, and the second side portion of the backrest is pivotally connected with the second front support by a second engaging mechanism. The first and second engaging mechanisms can be configured the same or differently. By way of example, FIGS. 2A-4B illustrate an exemplary chair having first and second engaging mechanisms 100 configured substantially the same.

In some exemplary embodiments, the engaging mechanism includes first, second and third members. The first member of the engaging mechanism is fixedly coupled with the backrest. The second member pivotally connects the first member of the engaging mechanism with a support of the frame (e.g., first or second front support), thereby allowing the backrest to rotate along the first axis in the width direction of the chair. The third member is fixedly coupled with the corresponding front support and configured to limit the rotation of the backrest.

Figure 5:
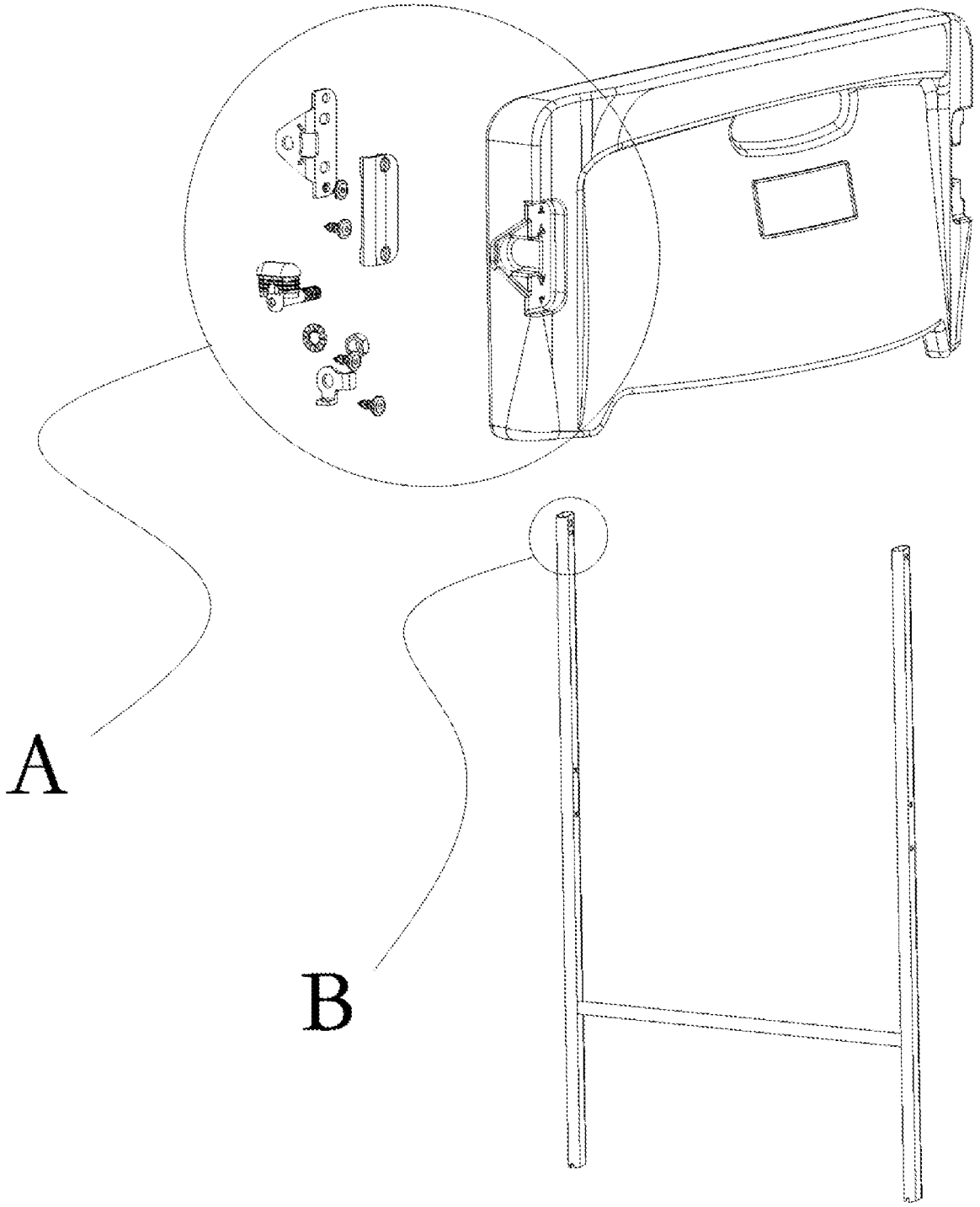
FIG. 5 is a disassembled view illustrating partially an exemplary chair in accordance with exemplary embodiments of the present disclosure.
Figure 6:
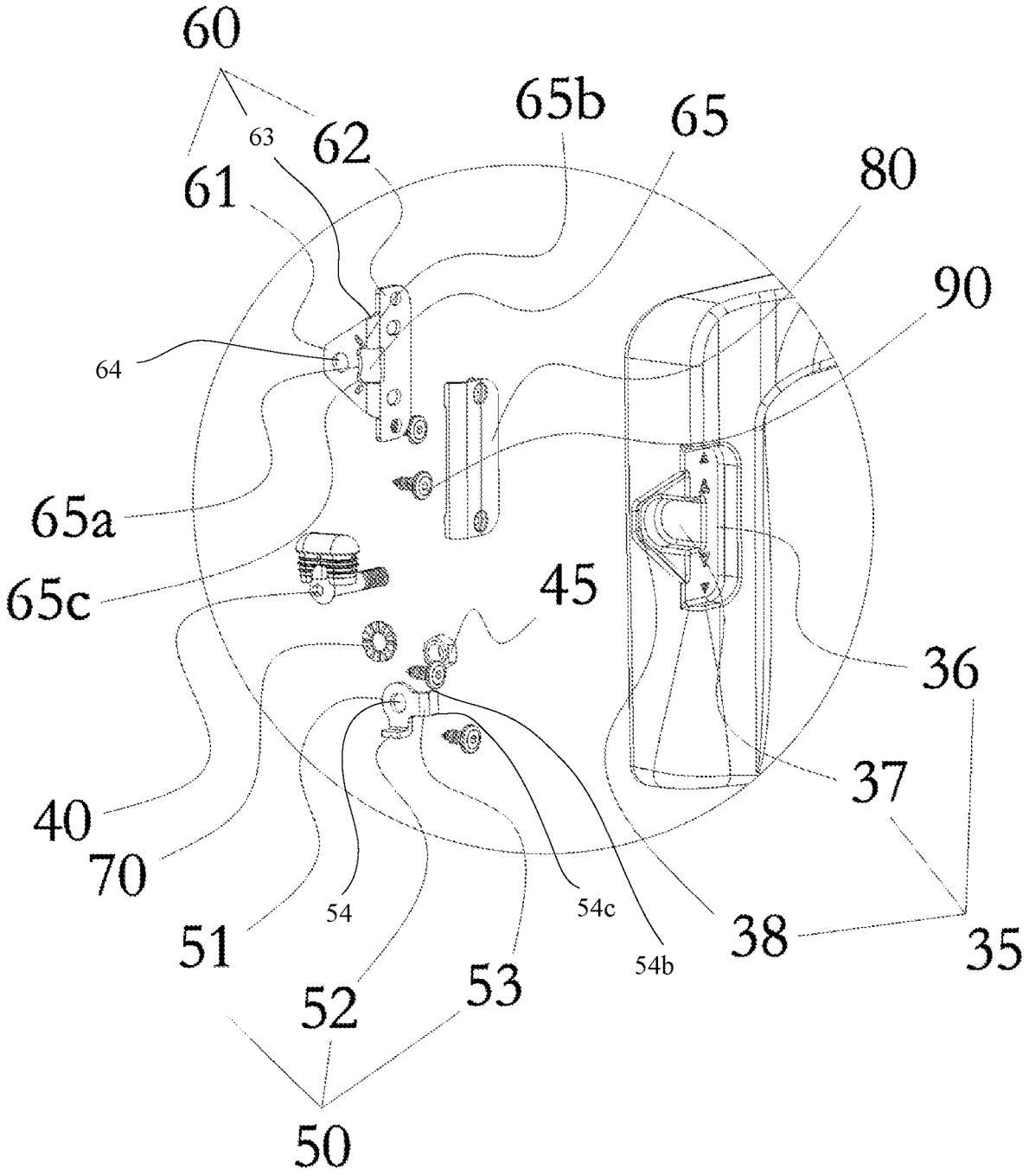
FIG. 6 is an enlarged view taken along circle A of FIG. 5.
Figure 7:
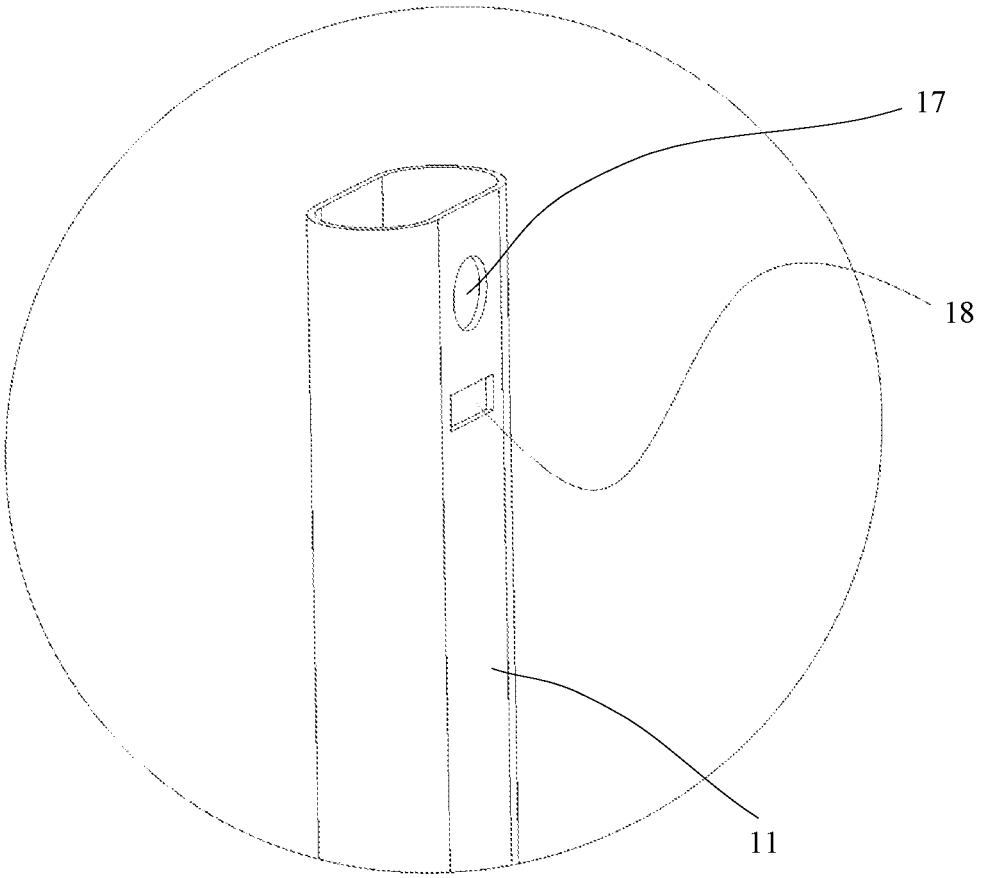
FIG. 7 is an enlarged view taken along circle B of FIG. 5.

For instance, referring to FIGS. 5-7, in some exemplary embodiments, engaging mechanism 100 including a first member such as first member 60. First member 60 includes a first portion such as first portion 62, a second portion such as second portion 61 bent with respect to the first portion, a third portion such as third portion 63 between the first and second portions. The first portion of first member 60 is fixedly connected with the backrest, for instance, fastened to the backrest by one or more fasteners 90. It should be noted that the first and second portions of the first member can be of any suitable shapes and sizes. By way of example, first portion 62 is shown of a general rectangular shape and second portion 61 is shown of a general triangular shape. In some exemplary embodiments, the first member of the engaging mechanism includes a second hole such as hole 64 and a second slot such as slot 65. In an exemplary embodiment, the second hole is formed at second portion 61 of the first member, and the second slot is formed at third portion 63 of the first member.

Engaging mechanism 100 also includes a second member having a fastener such as bolt 40 that is configured to pivotally connect the first member of the engaging mechanism with a support of the frame. For instance, in some exemplary embodiments, the support (e.g., the first or second front support) includes a first hole such as hole 17. Bolt 40 passes hole 17 of the support and hole 64 of the first member of the engaging mechanism, thereby pivotally connecting the first member of the engaging mechanism with the support. In an exemplary embodiment, the second member also including a nut such as nut 45 screwed onto an end of the bolt to prevent disengagement of the backrest from the support. In an exemplary embodiment, the support serves as a leg of the frame. For instance, the lower portion of front support 11 serves as a front leg of frame 10. In such cases, hole 17 is formed at an upper end portion of the support as illustrated in FIG. 7. Accordingly, the engaging mechanism is connected with the upper end portion of the support by bolt 40 passing through hole 17.

Engaging mechanism further includes a third member such as third member 50 fixedly coupled with the support and configured to limit the rotation of the backrest. For instance, in some exemplary embodiments, the support (e.g., the first or second front support) includes a first slot such as slot 18 as illustrated in FIG. 7. The first slot is formed at a side of the support facing the backrest. Third member 50 of the engaging mechanism is disposed between the support and the first member of the engaging mechanism and includes a first lug such as lug 52 and a second lug 53. The first lug of the third member is disposed in the first slot of the support and the second lug is disposed in the second slot of the first member of the engaging mechanism. It should be noted that the first and second lugs of the third member can be of any suitable shapes and sizes. By way of example, first lug 52 and second lug 53 each are shown of a general rectangular shape.

In some exemplary embodiments, the third member of the engaging mechanism includes a third hole such as hole 54 formed at a body portion such as body portion 51 of the third member of the engaging mechanism. It should be noted that the body portion of the third member can be of any suitable shapes and sizes. By way of example, body portion 51 is shown of a general circular shape. Bolt 40 passes through hole 17 of the support, hole 54 of the third member of the engaging mechanism, and hole 64 of the first member of the engaging mechanism, and thus helps secure the third member of the engaging mechanism on the support of the frame. In an exemplary embodiment, the first lug of the third member is bent with respect to the body portion in a first direction (e.g., toward the support), and the second lug is bent with respect to the body portion in a second direction that is different than the first direction (e.g., toward the first member of the engaging mechanism.

Slot 65 of the second slot of the first member of the engaging mechanism includes a first edge such as edge 65*c* and a second edge such as edge 65*b*. Lug 53 of the third member of the engaging mechanism has a first edge such as such 53*c* and a second edge such as edge 53*b*. Slot 65 and lug 53 are configured such that the distance between edge 65*c* and edge 65*b* of slot 65 is greater than the distance between edge 53*c* and edge 53*b* of lug 53. As such, the backrest is allowed to rotate between a first position, at which edge 56*c* of slot 56 of the first member abuts edge 53*c* of lug 53 of the third member, and a second position, at which edge 56*b* of slot 56 of the first member abuts edge 53*b* of lug 53 of the third member.

In some exemplary embodiments, the backrest at the first position (i.e., when edge 56*c* of slot 56 of the first member abuts edge 53*c* of lug 53 of the third member) is substantially vertical or tilted slightly with respect to the ground, and the backrest at the second position (i.e., when edge 56*b* of slot 56 of the first member abuts edge 53*b* of lug 53 of the third member) is tilted backward at a relatively larger angle than the backrest at the first position. The backrest at the first position can provide support when a user sits upright. When the user leans back from the upright posture, the backrest rotates or can be rotated manually to the second position to better fit the profile of the end user. When the user changes back to the upright position, the backrest rotates or can be rotated manually back to the first position. As such, the user can switch positions when needed or desired, and can sit comfortably for long duration.

In some exemplary embodiments, slot 65 of the second slot of the first member of the engaging mechanism further includes a third edge such as edge 65*a*. The third edge has a general convex contour. The third edge, along with lug 53 of the third member, helps to aid (e.g., guide or smooth) the rotation of the backrest along the first axis in the width direction of the chair between the first and second positions.

In some exemplary embodiments, the engaging mechanism includes additional, optional or alternative elements. For instance, in some exemplary embodiments, the engaging mechanism includes a spacer such as spacer 70 disposed between the first and third members of the engaging mechanism. In an exemplary embodiment, the spacer includes a corrugated surface having a plurality of radial ridges, a plurality of radial grooves, a plurality of alternate radial ridges and grooves, or the like. The spacer helps create a better feeling or sensation during the rotation of the backrest, and in some cases, increases the ease of adjusting the backrest. In some exemplary embodiments, the engaging mechanism further includes a fourth member such as fourth member 80 fixedly coupled with the backrest. The fourth member covers at least a portion of the first member of the engaging mechanism. It should be noted that the fourth member can be of any suitable shapes and sizes. By way of example, fourth member 80 is shown of a general rectangular shape.

In some exemplary embodiments, the backrest is formed with one or more indentations such as indentation 35. The one or more indentations are configured to accommodate at least a portion of the first member of the engaging mechanism, at least a portion of the second member of the engaging mechanism, or both. In an exemplary embodiment, the one or more indentations are configured to further accommodate at least a portion of the fourth member of the engaging mechanism. The fourth member generally levels with the back surface of the backrest, thereby enhancing the overall appearance of the backrest.

For instance, in some exemplary embodiments, corresponding to engaging mechanism 100, the backrest is formed with a first indentation such as first indentation 36, a second indentation such as second indentation 38 and a third indentation such as third indentation 37. First indentation 36 is recessed from a back surface of the respective side portion (e.g., first side portion 31 or second side portion 32) of the backrest toward a front surface of the backrest to accommodate the first portion of the first member of the engaging mechanism. Second indentation 38 is recessed inwardly from a side surface of the respective side portion of the backrest to accommodate the second portion of the first member of the engaging mechanism. Third indentation 37 is recessed inwardly from a bottom surface of the second indentation to accommodate an end portion of the fastener (e.g., an end portion of bolt 40 and/or nut 45) of the second member of the engaging mechanism. In an exemplary embodiment, first indentation 36 is recessed further to accommodate at least a portion of fourth member 80 of the engaging mechanism such that the fourth member generally levels with the back surface of the backrest or the back surface of the side portion of the backrest. As such, it enhances the overall appearance of the backrest.

While in the illustrated embodiments backrest 30 is coupled with the front supports of foldable frame 10, it should be noted that this is by way of example and is not limiting. The backrest can be connected to any suitable support of any suitable chair frame, whether it is foldable or non-foldable. For instance, some chairs have rear vertical supports serving as back supports and/or rear legs. In such cases, the backrest can be connected with the rear vertical supports by the engaging mechanism of the present disclosure or the like. Other chairs have slant supports serving as back support and/or front legs similar to those of frame 10. In such cases, the backrest can be connected with the slant supports.

The chairs of the present disclosure have several advantages. For instance, the backrest of the chair can adjust its positions in accordance with the profiles or postures of end users. For instance, when a user leans back from an upright posture, the backrest rotates or can be rotated manually so that the backrest tilts backward to better fit the profile of the end user. When the user changes back to the upright position, the backrest rotates or can be rotated manually back to the vertical state. Specifically, the backrest can rotate between a first position, at which edge 56*c* of slot 56 of the first member abuts edge 53*c* of lug 53 of the third member of the engaging mechanism, and a second position, at which edge 56*b* of slot 56 of the first member abuts edge 53*b* of lug 53 of the third member of the engaging mechanism. In addition, the spacer helps create a better feeling or sensation during the rotation of the backrest and in some cases increases the ease of adjusting the backrest.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "top" or "bottom", "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first support could be termed a second support, and, similarly, a second support could be termed a first support, without changing the meaning of the description, so long as all occurrences of the "first support" are renamed consistently and all occurrences of the "second support" are renamed consistently.

What is claimed is:

1. A chair comprising:

a seat;

a backrest;

a frame to support the seat and backrest, wherein the frame comprises a first support disposed at a first side of the chair, and a second support disposed at a second side of the chair and spaced apart from the first support in a width direction of the chair;

a first engaging mechanism disposed at the first side of the chair and pivotally coupling the backrest with the first support; and a second engaging mechanism disposed at the second side of the chair and pivotally coupling the backrest with the second support, wherein a respective engaging mechanism in the first and second engaging mechanisms comprises:

a first member fixedly coupled with the backrest; a second member pivotally connecting the first member of the respective engaging mechanism with a corresponding support in the first and second supports, thereby allowing the backrest to rotate along a first axis in the width direction of the chair; and a third member fixedly coupled with the corresponding support and configured to limit the rotation of the backrest; wherein:

the corresponding support comprises a first hole and a first slot, wherein the first slot is formed at a side of the corresponding support facing the backrest;

the first member of the respective engaging mechanism comprises a second hole and a second slot;

the third member of the respective engaging mechanism is disposed between the corresponding support and the first member of the respective engaging mechanism, wherein the third member comprises a third hole, a first lug disposed in the first slot of the corresponding support, and a second lug disposed in the second slot of the first member of the respective engaging mechanism; and the second member of the respective engaging mechanism comprises a fastener passing through the first hole of the corresponding support, the second hole of the first member of the respective engaging mechanism, and the third hole of the third member of the respective engaging mechanism;

wherein a distance between a first edge and a second edge of the second slot of the first member of the respective engaging mechanism is greater than a distance between a first edge and a second edge of the second lug of the third member of the respective engaging mechanism, thereby allowing the backrest to rotate between a first position at which the first edge of the second slot of the first member of the respective engaging mechanism abuts the first edge of the second lug of the third member of the respective engaging mechanism and a second position at which the second edge of the second slot of the first member of the respective engaging mechanism abuts the second edge of the second lug of the third member of the respective engaging mechanism;

wherein the first member of the respective engaging mechanism comprises a first portion, a second portion bent with respect to the first portion, a third portion between the first and second portions; and wherein the backrest comprises:

a first indentation recessed from a back surface of the backrest toward a front surface of the backrest to accommodate the first portion of the first member of the respective engaging mechanism;

a second indentation recessed inwardly from a side surface of the backrest to accommodate the second portion of the first member of the respective engaging mechanism; and a third indentation recessed inwardly from a bottom surface of the second indentation to accommodate an end portion of the fastener of the second member of the respective engaging mechanism.

2. The chair of claim 1, wherein the corresponding support serves as a leg of the frame, and the respective engaging mechanism is connected with an upper end portion of the corresponding support.

3. The chair of claim 1, wherein the backrest is formed with one or more indentations to accommodate at least a portion of the first member of the respective engaging mechanism, at least a portion of the second member of the respective engaging mechanism, or both.

4. The chair of claim 1, wherein the second slot of the first member of the respective engaging mechanism comprises a convex third edge to aid rotation of the backrest along the first axis in the width direction of the chair between the first and second positions.

5. The chair of claim 1, wherein the first portion is fixedly connected with the backrest, the second hole is formed at the second portion, and the second slot is formed at the third portion.

6. The chair of claim 1, wherein the third hole is formed at a body portion of the third member of the respective engaging mechanism, the first lug is bent with respect to the body portion in a first direction, and the second lug is bent with respect to the body portion in a second direction that is different than the first direction.

7. The chair of claim 1, wherein the respective engaging mechanism further comprises a fourth member fixedly coupled with the backrest and configured to cover at least a portion of the first member of the respective engaging mechanism.

8. The chair of claim 1, wherein the respective engaging mechanism further comprises a spacer disposed between the first and third members of the respective engaging mechanism, wherein the spacer comprises a corrugated surface having a plurality of radial ridges, a plurality of radial grooves, or a plurality of alternate radial ridges and grooves.

9. A chair comprising:

first and second front supports spaced apart in a width direction of the chair;

first and second rear supports spaced apart in the width direction of the chair;

a first link having a first end pivotally connected with the first front support and a second end pivotally connected with the first rear support;

a second link having a first end pivotally connected with the second front support and a second end pivotally connected with the second rear support;

a seat having a first side portion pivotally connected with the first front support and the first rear support below the first link and a second side portion pivotally connected with the second front support and the second rear support below the second link; and a backrest having a first side portion pivotally connected with the first front support above the first link and a second side portion pivotally connected with the second front support above the second link such that the backrest is rotatable along a first axis in the width direction of the chair;

wherein a respective side portion in the first and second side portions of the backrest is pivotally connected with a corresponding front support in the first and second front supports by an engaging mechanism, wherein the engaging mechanism comprises:

a first member fixedly coupled with the respective side portion of the backrest;

a second member pivotally connecting the first member of the engaging mechanism with the corresponding front support, thereby allowing the backrest to rotate along the first axis in the width direction of the chair; and a third member fixedly coupled with the corresponding front support and configured to limit the rotation of the backrest; wherein:

the corresponding front support comprises a first hole and a first slot, wherein the first slot is formed at a side of the corresponding front support facing the backrest;

the first member of the engaging mechanism comprises a second hole and a second slot;

the third member of the engaging mechanism is disposed between the corresponding front support and the first member of the engaging mechanism, wherein the third member comprises a third hole, a first lug disposed in the first slot of the corresponding front support, and a second lug disposed in the second slot of the first member of the engaging mechanism; and the second member of the engaging mechanism comprises a fastener passing through the first hole of the corresponding front support, the second hole of the first member of the engaging mechanism, and the third hole of the third member of the engaging mechanism;

wherein a distance between a first edge and a second edge of the second slot of the first member of the engaging mechanism is greater than a distance between a first edge and a second edge of the second lug of the third member of the engaging mechanism, thereby allowing the backrest to rotate between a first position at which the first edge of the second slot of the first member of the engaging mechanism abuts the first edge of the second lug of the third member of the engaging mechanism and a second position at which the second edge of the second slot of the first member of the engaging mechanism abuts the second edge of the second lug of the third member of the engaging mechanism;

wherein the first member of the engaging mechanism comprises a first portion, a second portion bent with respect to the first portion, a third portion between the first and second portions; and wherein the backrest comprises:

a first indentation recessed from a back surface of the respective side portion of the backrest toward a front surface of the respective side portion of the backrest to accommodate the first portion of the first member of the engaging mechanism;

a second indentation recessed inwardly from a side surface of the respective side portion of the backrest to accommodate the second portion of the first member of the engaging mechanism; and a third indentation recessed inwardly from a bottom surface of the second indentation to accommodate an end portion of the fastener of the second member of the engaging mechanism.

10. The chair of claim 9, wherein the respective side portion of the backrest is formed with one or more indentations to accommodate at least a portion of the first member of the engaging mechanism, at least a portion of the second member of the engaging mechanism, or both.

11. The chair of claim 9, wherein the second slot of the first member of the engaging mechanism comprises a convex third edge to aid rotation of the backrest along the first axis in the width direction of the chair between the first and second positions.

12. The chair of claim 9, wherein the first portion is fixedly connected with the backrest, the second hole is formed at the second portion, and the second slot is formed at the third portion.

13. The chair of claim 9, wherein the third hole is formed at a body portion of the third member of the engaging mechanism, the first lug is bent with respect to the body portion in a first direction, and the second lug is bent with respect to the body portion in a second direction that is different than the first direction.

14. The chair of claim 9, wherein the engaging mechanism further comprises a fourth member fixedly coupled with the backrest and configured to cover at least a portion of the first member of the engaging mechanism.

15. The chair of claim 9, wherein the respective engaging mechanism further comprises a spacer disposed between the first and third members of the respective engaging mechanism, wherein the spacer comprises a corrugated surface having a plurality of radial ridges, a plurality of radial grooves, or a plurality of alternate radial ridges and grooves.

* * * * *